US005179999A

United States Patent [19]

Meekins et al.

[11] Patent Number: 5,179,999

[45] Date of Patent: Jan. 19, 1993

[54] CIRCUMFERENTIAL FLOW HEAT EXCHANGER

[75] Inventors: Kris J. Meekins; Jeffrey P. Benson, both of Bemus Point, N.Y.

[73] Assignee: Long Manufacturing Ltd., Oakville, Canada

[21] Appl. No.: 808,367

[22] Filed: Dec. 16, 1991

Related U.S. Application Data

[63] Continuation-in-part of Ser. No. 437,680, Nov. 17, 1989, and a continuation-in-part of Ser. No. 484,252, Feb. 26, 1990.

[51] Int. Cl.[5] ..... F28F 3/08

[52] U.S. Cl. ..... 165/41; 165/167; 165/916

[58] Field of Search ..... 165/41, 51, 166, 167, 165/916

[56] References Cited

U.S. PATENT DOCUMENTS

| | | | |
|---|---|---|---|
| 2,251,066 | 7/1941 | Persson et al. | 165/167 |
| 2,777,674 | 1/1957 | Wakeman | 165/167 |
| 3,372,744 | 3/1968 | Skoog | 165/167 |
| 3,661,203 | 5/1972 | Mesher | 165/167 |
| 4,260,013 | 4/1981 | Sumitomo | 165/75 |
| 4,360,055 | 11/1982 | Frost | 165/38 |
| 4,742,866 | 5/1988 | Yamanaka et al. | 165/38 |
| 4,911,235 | 3/1990 | Andersson et al. | 165/167 |

FOREIGN PATENT DOCUMENTS

| | | | |
|---|---|---|---|
| 2639371 | 3/1977 | Fed. Rep. of Germany | 165/167 |

*Primary Examiner*—Allen J. Flanigan
*Attorney, Agent, or Firm*—Moss, Barrigar & Oyen

[57] ABSTRACT

An improvement in circumferential flow heat exchangers of the type having a stack of heat exchange units each formed from first and second thin plates having grooves and ribs, wherein the grooves and ribs on facing surfaces of the first and second plates of a unit cross one another and cooperate to define a first flow path extending once about the interior of such unit through less than about one circumscription and grooves and ribs on facing surfaces of first and second plates of adjacent units cross one another and cooperate to define a second flow path, characterized in that the first and second plates of each unit are configured to provide the second flow path with a cross-sectional area exceeding the cross-sectional area of the first flow path.

17 Claims, 2 Drawing Sheets

Fig.1.
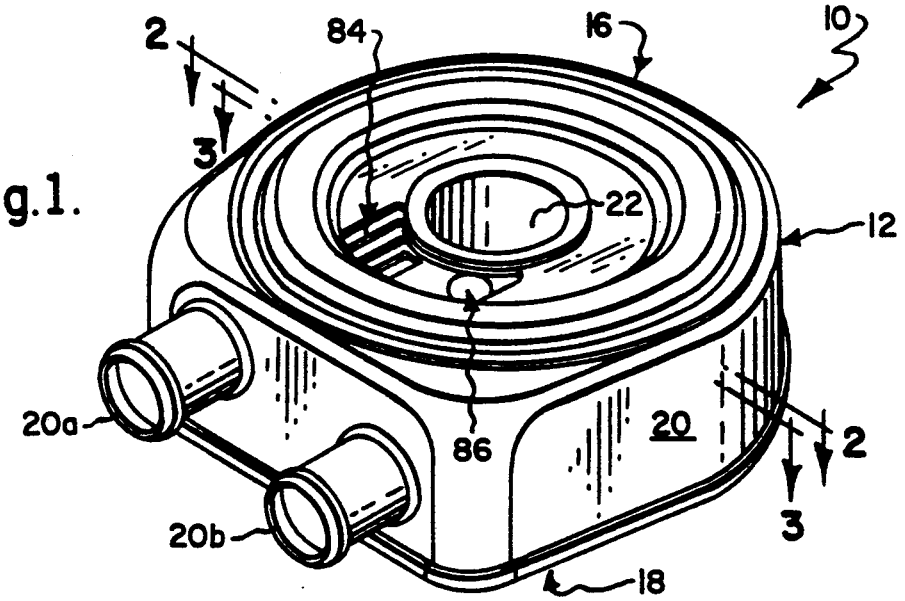
Fig. 4.
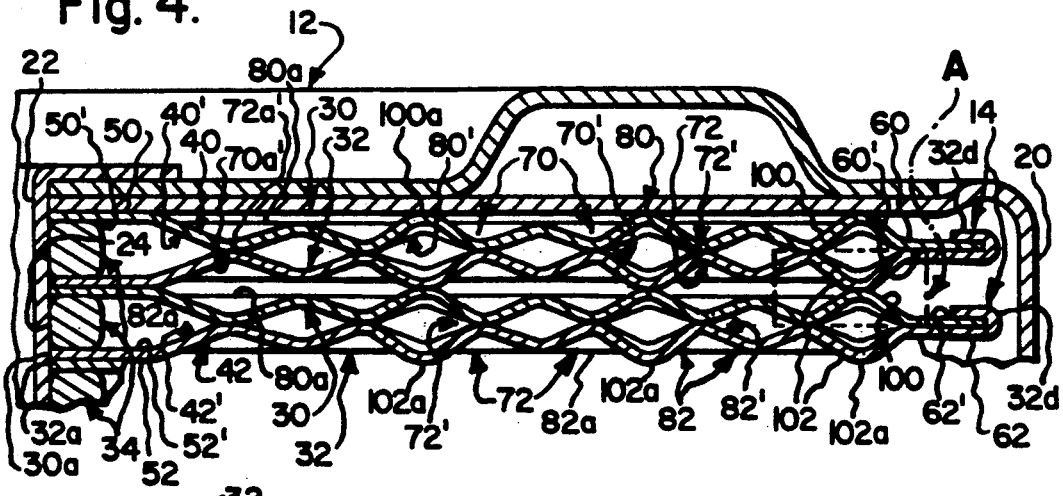
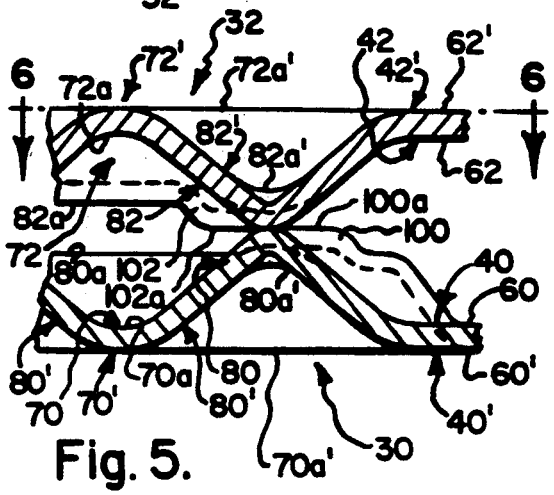
Fig. 5.
Fig. 6.
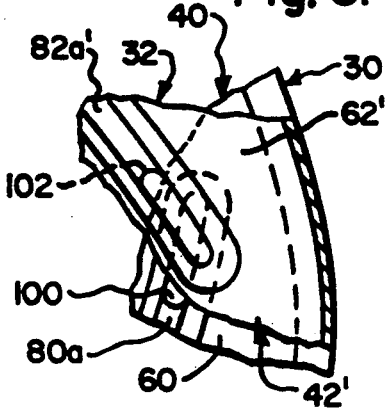

CIRCUMFERENTIAL FLOW HEAT EXCHANGER

BACKGROUND OF THE INVENTION

This application is a continuation-in-part of U.S. patent application Ser. No. 07/437,680, filed Nov. 17, 1989 and Ser. No. 07/484,252, filed Feb. 26, 1990.

It is known to provide oil coolers for vehicle engines, which are arranged between an engine block and an oil filter and connected to an engine cooling system to permit a cooling liquid, such as water, to pass in heat exchange relationship with oil while flowing through the oil cooler.

In commonly assigned co-pending U.S. patent application Ser. No. 07/437,680, filed Nov. 17, 1989 and Ser. No. 07/484,252, filed Feb. 26, 1990, there is disclosed circumferential flow heat exchangers having a stack of like heat exchange units each formed from first and second plates, wherein the plates of each unit cooperate to define a first flow path and the plates of a pair of adjacent units cooperate to define a second flow path with the cross-sectional areas of such flow paths being essentially equal. Typically, when these heat exchangers are employed as engine oil coolers, oil and water are caused to flow along the first and second flow paths, respectively.

Heat exchange units disclosed by these prior applications are effective in controlling movement, i.e. mixing or turbulence, of oil along the first flow paths in a manner which tends to maximize exposure thereof to heat transfer contact with flow bounding surfaces of the plates. In particular, tests conducted on units featuring mixing elements in the form of grooves and ribs extending generally along involute curves demonstrate superior oil heat transfer characteristics as compared to present commercially competitive units within the middle to upper ranges of oil flow rates typically encountered in engine oil cooling systems. However, oil heat transfer characteristics are not fully satisfactory within a lower range of oil flow rates.

SUMMARY OF THE INVENTION

The present invention relates to circumferential flow heat exchangers, and more particularly to improvements in circumferential flow heat exchangers of the general type disclosed in commonly assigned U.S. patent application Ser. No. 07/437,680, filed Nov. 17, 1989 and Ser. No. 07/484,252, filed Feb. 26, 1990.

In accordance with the present invention, the configurations of the first and second plates forming heat exchange units of the type disclosed in the above referenced patent applications are changed in a manner allowing for the cross-sectional areas of the first and second flow paths defined by each unit and a pair of adjacent units to be selectively varied in size, as required to optimize oil heat transfer characteristics throughout the full range of oil flow rates typically encountered in vehicle engines.

The present invention broadly contemplates reducing the height of crests of ribs formed on the outer or oppositely facing surfaces of the first and second plates of each unit, and thereby reducing the spacing between the troughs of grooves formed on the inner or facing surfaces of the plates in alignment with such ribs, in order to effect a relative decrease and increase of the cross-sectional areas of the first and second flow paths, respectively. Spacing between units, and thus the cross-sectional areas of each of the second flow paths defined thereby are maintained uniform, by providing the ribs with integrally formed projections having heights corresponding to the reduction in height of the ribs, as required to provide the units with a desired overall thickness or height. Accordingly, a reduced flow restriction may be provided for coolant flowing along the second flow paths, as compared to oil flowing along the first flow paths, resulting in the ability to substantially change or control the relative pressure drops to which coolant and oil are subjected in passing through an oil cooler, as required to optimize heat transfer efficiency and provide pressure drop characteristics satisfying automotive industry performance requirements.

Increasing the effective cross-sectional area of the second flow paths, as compared to that of the first flow paths, allows the density of the ribs and grooves present on a given unit of surface area of the plates to be increased, as compared to the density permissible with heat exchange units disclosed by the above referenced patent application, thereby serving to increase mixing or turbulence efficiency of the oil without resulting in an oil cooler having an unacceptable water pressure drop performance.

BRIEF DESCRIPTION OF THE DRAWINGS

The nature and mode of operation of the present invention will now be more fully described in the following detailed description taken with the accompanying drawings wherein:

FIG. 1 is a perspective of a heat exchanger incorporating a plurality of heat exchange units formed in accordance with the present invention;

FIG. 4 is a sectional view taken generally along the line 4—4 in FIG. 2;

FIG. 5 is an enlarged view of the area designated as A in FIG. 4; and

FIG. 6 is a view taken generally along the line 6—6 in FIG. 5.

DETAILED DESCRIPTION OF THE INVENTION

Figure 2:
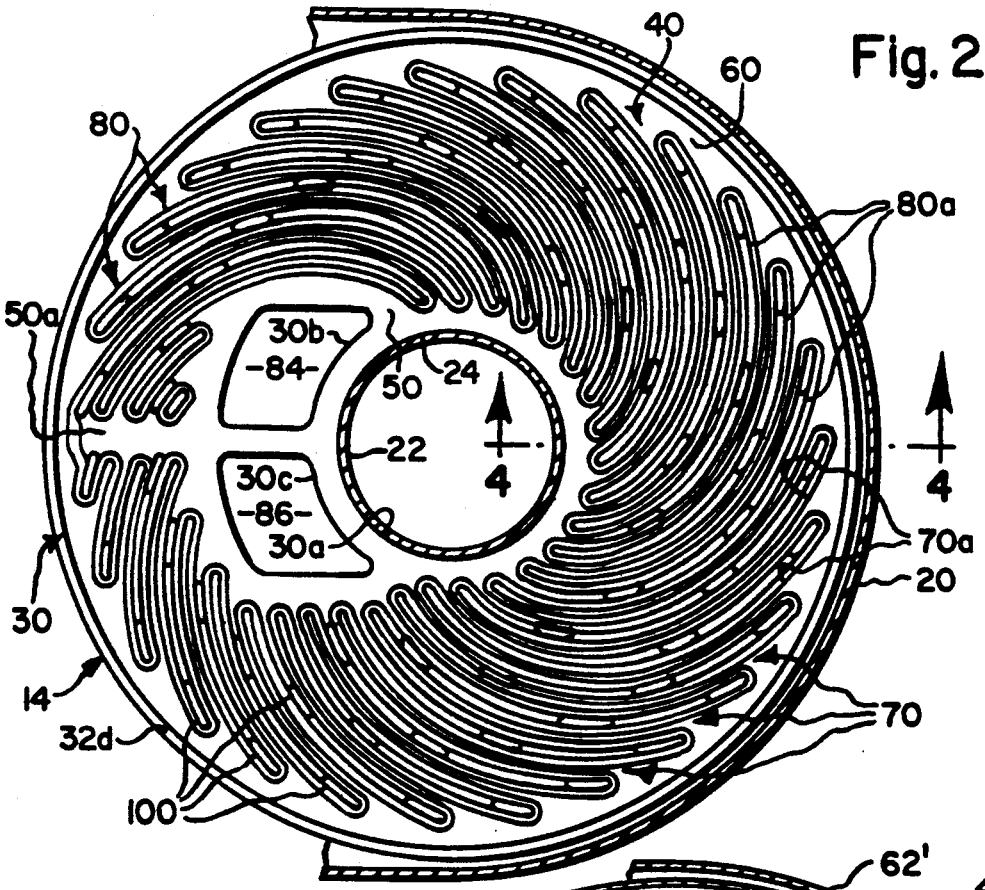
FIG. 2 is a sectional view taken generally along the line 2—2 in FIG. 1 and showing an outer surface of a first plate of one of the heat exchange units.

An exemplary embodiment of the present invention will be described for use in an automotive oil cooler 10 of the type illustrated in FIG. 1 and intended to be installed between the automotive engine and the oil filter, not shown. It should, however, be understood that the present invention can be utilized in a plurality of other applications, wherein it is desired to effect heat exchange between dissimilar fluids. Automotive oil cooler 10 generally includes a canister 12 housing a stack of heat exchange units designed as 14 in FIGS. 2 and 4. Canister 12 is defined by an oil filter attachment end portion 16, motor attachment end portion 18, an exterior canister side wall portion 20 provided with coolant outlet and inlet connections **20*a* and 20*b*, and a centrally located sleeve portion 22, which is end connected to end portions 16 and 18 and arranged to extend through centrally disposed registration openings 24 of units 14 when they are arranged in a stacked relationship within the canister, as indicated in FIG. 4**.

Figure 3:
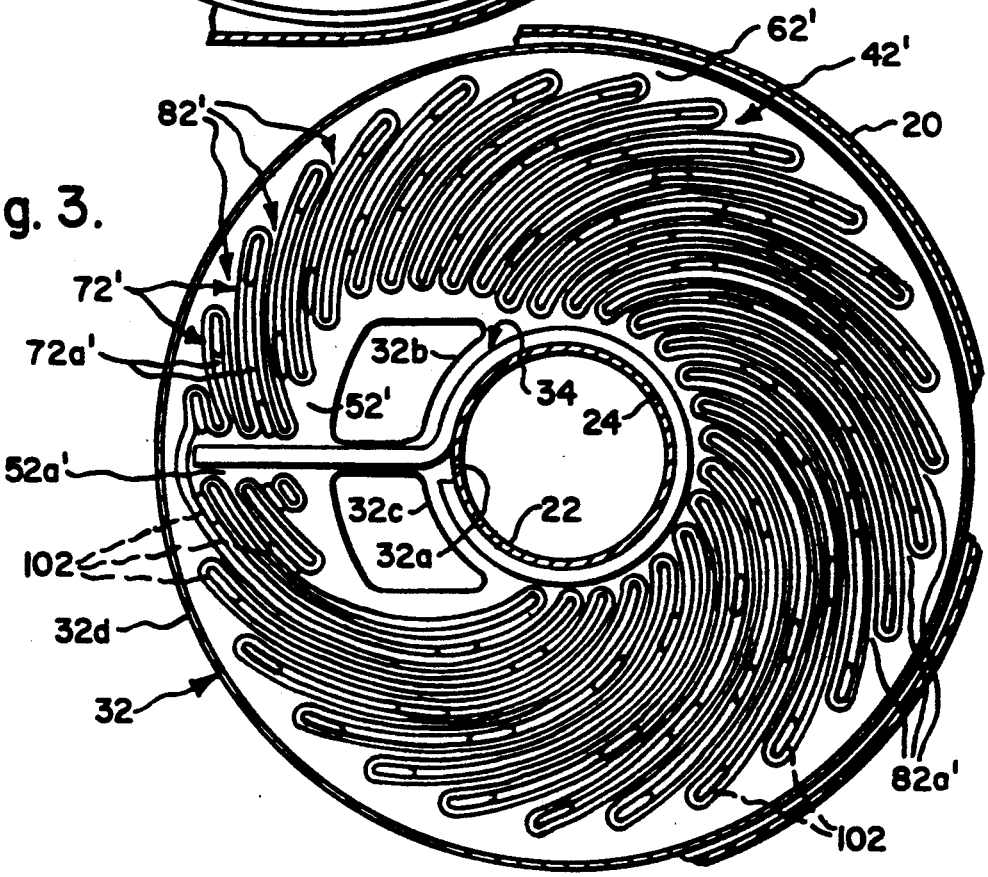
FIG. 3 is a sectional view taken generally along the line 3—3 in FIG. 1 and showing an inner surface of a second plate of one of the heat exchange units.

Heat exchange units 14 are similar to those described in the above mentioned U.S. Patent Applications, whose disclosure is incorporated by reference herein, in that each unit is defined by first and second plates 30 and 32 shown in FIGS. 2 and 3, respectively; and a flow separator 34 shown in FIGS. 3 and 4. Plates 30 and 32 may be formed of thin sheet metal stock and die cut to define registration openings 30*a* and 32*a*, oil outlet openings 30*b* and 32*b*, and oil inlet openings 30*c* and 32*c*, and embossed or otherwise formed to define a plurality of flow directing elements to be described. Preferably, the diameter of plate 32 exceeds that of plate 30 to provide material for defining an annular flange portion 32*d* intended to clamp about the peripheral edge of its associated plate 30 as shown in FIGS. 2 and 4.

As formed, plates 30 and 32 have first surfaces 40 and 42 of like configuration and second or opposite surfaces 40' and 42' of like configuration. When plates 30 and 32 are assembled or joined together with separator 34 to form unit 14, first surfaces 40 and 42 are arranged to define outer or oppositely facing surfaces of the unit and second surfaces 40' and 42' are arranged to define inner or facing surfaces of the unit. Thus, when plates 30 and 32 are in assembled relationship with openings 30*a*, 30*b* and 30*c* arranged in alignment with openings 32*a*, 32*b* and 32*c*, respectively, outer surfaces 40 and 42 of unit 14 define mirror images of one another and inner surfaces 40' and 42' of the unit define mirror images of one another.

To facilitate the following description of the surface configurations of plates 30 and 32, elements of the second or inner surfaces 40' and 42' of the plates defined by shaping of the first or outer surfaces 40 and 42 of the plates will be designated by like primed numbers. Thus, it will be seen by viewing FIGS. 2–4, that plates 30 and 32 are shaped to provide unembossed or reference planar surfaces 50 and 52 with aligned oppositely facing planar surfaces 50' and 52', which bound openings 30*a*, 32*a*, 30*b* and 32*b*, 30*c*, 32*c*; embossed, peripherally extending planar surfaces 60 and 62 with aligned oppositely facing planar surfaces 60' and 62'; a plurality of embossed outer grooves or valleys 70 and 72 with aligned oppositely facing inner ribs 70' and 72'; and a plurality of outer rib 80 and 82, which are disposed intermediate grooves 70 and 72, with aligned inner grooves or valleys 80' and 82'. Planar surfaces 50 and 52, and thus aligned surfaces 50' and 52' include dividing surface portions, which, as shown only for the case of dividing surface portions 50*a* and 52*a'* in FIGS. 2 and 3, respectively, extend radially outwardly from between openings 30*b*, 30*c*, and 32*b*, 32*c* towards peripherally extending surfaces 60 and 62 and thus aligned surfaces 60' and 62'.

When unit 14 is assembled, peripherally extending planar surfaces 60' and 62' are disposed in sealing engagement, and separator 34 is arranged between plate surfaces 40' and 42' in the manner shown in FIGS. 3 and 4, such that it sealingly engages with planar surfaces 50' and 52' in alignment with registration openings 30*a* and 32*a*, whereby to cooperate therewith to define registration opening 24 of unit 14, and such that it sealingly engages with dividing surface portion 52*a'* and its facing dividing surface portion, not shown, to separate an oil outlet opening 84 of the unit bounded by aligned openings 30*b* and 32*b* from an oil inlet opening 86 of the unit bounded by aligned openings 30*c* and 32*c*. Thus, oil entering unit 14 via inlet opening 86 is directed to flow once about the interior of the unit along a first flow path defined by inner grooves 80' and 82' and inner ribs 70' and 72' for discharge through outlet opening 84.

When units 14 are assembled and bonded together in a stacked relationship, all of surfaces 40 of plates 30 face in one direction and all of surfaces 42 of plates 32 face in an opposite direction with plates 30 and 32 of a pair of adjacent units having their outer surfaces 40 and 42 disposed in engagement for cooperation to define a second or water flow path defined by outer grooves 70 and 72 and outer rib portions 90 and 82.

It is characteristic of prior heat oil coolers formed in accordance with the above referenced patent applications that the crest portions 70*a'* and 72*a'* of inner ribs 70' and 72' are disposed in abutting engagement and lie essentially coplanar with peripherally extending planar surfaces 60' and 62'; the trough portions 80*a'* and 82*a'* of inner grooves 80' and 82' are disposed to lie essentially coplanar with planar surfaces 50' and 52'; the crest portions 80*a* and 82*a* of outer ribs 80 and 82 of adjacent units are disposed in abutting engagement and lie essentially coplanar with planar surfaces 50 and 52; and the trough portions 70*a* and 72*a* of outer grooves 70 and 72 lie essentially coplanar with peripherally extending planar surfaces 60 and 62. With this type of construction, the cross-sectional areas or sizes of the first and second flow paths are essentially equal.

In prior U.S. patent application Ser. No. 07/437,680, the grooves and ribs tend to extend along curves, which are preferably involute, outwardly from adjacent the interior planar surfaces of the plates towards the peripheral planar surfaces of the plates. In prior U.S. patent application Ser. No. 07/484,252, the grooves and ribs are essentially straight and arranged at oblique angles to the general direction of flow of liquid between the inlet and outlet of each unit. In both forms, the first flow path extends once about the interior of each heat exchange unit through less than one complete circumscription.

In accordance with the illustrated and preferred form of the present invention, the grooves and ribs of the plates of each heat exchanger unit extended generally along involute curves, spirals, etc. It is to be understood, however, that the invention is not limited to the use of involute curves and may have utility when the flow path is defined by essentially straight cooperating grooves and ribs as disclosed in U.S. patent application Ser. No. 07/484,252.

Unit 14 of the present invention departs from the prior construction of the type generally described above in that the crests 80*a* and 82*a* of outer ribs 80 and 82 are disposed or arranged vertically intermediate the troughs 70*a* and 72*a* of outer grooves 70 and 72 and planar surfaces 50 and 52, and such outer ribs are provided with a plurality of integrally formed projections 100 and 102 whose crests 100*a* and 102*a* are disposed to lie essentially coplanar with planar surfaces 50 and 52, as best shown in FIGS. 4 and 5. Thus, when adjacent units 14 are disposed in a stacked relationship with their respective openings 24, 84 and 86 disposed in alignment, the crests 80*a* and 82*a* of outer ribs 80 and 82 of adjacent units are disposed in a spaced relationship and crests 100*a* and 102*a* of projections 100 and 102 of adjacent units are disposed in engagement. Preferably, at least one projection is provided on each of outer ribs 80 and 82 with the longest of such outer ribs having multiple uniformly spaced projections and with the projections on adjacent outer ribs being staggered or offset relative to one another, as shown in FIGS. 2 and 3. Projections 100 and 102 are also preferably slightly elongated in a direction lengthwise of their associated ribs 80 and 82, such that engaged projections assume an X-shaped pattern, as best shown in FIG. 6, when a stack of units 14 is viewed in plan. Spacing between the crests 80*a* and 82*a* of outer ribs 80 and 82 provides for a greater flow cross-sectional area for water flowing within canister 12 between adjacent units 14 than the flow cross-sectional area provided for oil flowing within such adjacent units, and as a result, the pressure drop of water passing through cooler 10 may be substantially reduced, as compared to the pressure drop of oil passing through such cooler.

The grooves and ribs may be of like cross-section and have their troughs and crests of like radius. However, it is contemplated that the radius of curvature of the crests 80*a* and 82*a* of the outer ribs 80 and 82 may exceed the radius of curvature of the troughs 70*a* and 72*a* of the outer grooves 70 and 72 with a view towards forming of projections 100 and 102 with a minimum reduction in plate thickness and thus strength adjacent the projections. Unequal radius of curvature of the crests and troughs of the outer ribs and grooves necessarily results in their being unequal radius of curvature of the crests and troughs of the inner ribs and grooves, and this in turn offers a further mechanism for producing variations in the cross-sectional areas of the first and second flow paths.

An increase in the cross-sectional area of the second flow paths relative to the first flow paths further allows for an increase in the density of the ribs and grooves present on a given unit of surface area of plates 30 and 32 to be increased, as compared to that of heat exchange units disclosed by the above referenced patent applications, thereby serving to further increase mixing or turbulence to which oil is exposed without resulting in an oil cooler having unacceptable water pressure drop performance.

It will also be understood that the arcuate lengths of the grooves and ribs may be varied to vary operating conditions of a circumferential flow oil cooler depicted in the drawings. Changes in arcuate lengths combined with changes in density of the grooves and ribs may be tailored to achieve desired results. Thus, if the number of grooves and ribs is held constant, decreases in their arcuate lengths would tend to decrease the oil pressure drop, while the pressure drop of water would tend to remain relatively constant. On the other hand, if the arcuate lengths of the grooves and ribs is maintained constant and their number is increased, the pressure drop of the oil tends to increase, while the pressure drop of water would tend to remain the same. Once a desired water pressure drop is established, arcuate lengths and densities of the grooves and ribs may be determined to provide an oil cooler having desired characteristics.

Operating characteristics of an oil cooler can also be varied for any given installation axial length or envelope by for instance decreasing the number of heat exchange units in a stack as an incident to increasing the individual axial length of each unit in a manner which increases the cross-sectional area of the second flow path without change of the cross-sectional area of the first flow path or by for instance maintaining the number of units in a stack constant and increasing or decreasing the heights of the outer ribs to vary the cross-sectional areas of both of the first and second flow paths.

As by way of example, a first oil cooler employing heat transfer units formed in accordance with the present invention and having the presently best obtainable performance was compared against a second oil cooler formed in accordance with the disclosure of U.S. patent application Ser. No. 07/437,680 and having the previous best obtainable performance, while staying within industry acceptable oil and water pressure drop standards. Each oil cooler employed a stack of thirteen heat transfer units having an overall length of 1.2 inches. The first cooler was found to have water and oil pressure drops of about three pounds and fifteen pounds, respectively, whereas the second oil cooler was found to have water and oil pressure drops of about five pounds and nine pounds, respectively. The first oil cooler was found to have an increase in oil heat transfer rate of about 0.5 btu/min deg FITD over an oil flow range of from about 20 to 80 lbs/min at 240° F. and a coolant flow rate of 40 lbs/min at 180° F.

What is claimed is:

1. A heat exchanger comprising:

a stack of heat exchange units, wherein each of said units is formed from a pair of plates engaging one another and cooperating to define a first flow path therebetween; a pair of adjacent units engaging one another and cooperating to define a second flow path therebetween; the plates of each said pair of plates having inner facing surfaces and outer oppositely facing surfaces, said outer surfaces of said plates each being shaped to define a planar portion, a peripheral portion spaced from said planar portion, a plurality of outer grooves, and outer ribs disposed one between each of said outer grooves, said outer grooves and ribs of a first of said plates of said pair extending in a direction opposite to said outer grooves and ribs of a second of said plates of said pair, said outer grooves forming inner ribs on adjacent inner facing surfaces disposed in surface-to-surface engagement and in a crossing relationship, said planar and peripheral portions of each plate pair being fluid sealed relative to one another, said planar portions of said plates of said pairs of plates being apertured to afford flow communication into and out of said first flow paths of adjacent units and said planar portions of adjacent plate pairs having facing surfaces thereof fluid sealed relative to one another to cause flow between respective first flow paths; said outer ribs having crest portions disposed in a direction normal to said outer surfaces, a plurality of projections formed integrally with said outer ribs and having engagement surfaces, said engagement surfaces of said first plates of said pair being disposed in engagement with said engagement surfaces of said second plates of an adjacent pair of plates of said stack whereby said second flow path is of greater effective cross-sectional area than said first flow path.

2. A heat exchanger according to claim 1, wherein said projections are elongated in a direction extending lengthwise of said outer ribs.

3. A heat exchanger according to claim 1, wherein essentially all of said outer ribs have at least one projection formed integrally therewith.

4. A heat exchanger according to claim 1, wherein said outer grooves and said ribs are essentially uniformly spaced and extend generally along involute curves away from said planar portion towards said peripheral portion.

5. A heat exchanger according to claim 4, wherein essentially all of said outer ribs have at least one projection formed integrally therewith.

6. A heat exchanger according to claim 5, wherein said projections are elongated in a direction extending lengthwise of said outer ribs.

7. A heat exchanger according to claim 1 and further comprising housing means for receiving said stack of units and having a first flow means communicating with said first flow path and a second flow means communicating with said second flow path.

8. A heat exchanger as claimed in claim 1 and further comprising a flow separator located between the flow inlet and outlet openings and in sealing engagement with the plate inner surfaces.

9. A heat exchanger unit for a heat exchanger comprising: first and second plates having oppositely facing outer and inner surfaces, said outer surfaces having elongated outer grooves, and elongated outer ribs arranged between said outer grooves and extending codirectionally therewith, said inner surfaces having inner ribs and grooves aligned respectively with said outer grooves and ribs, said inner ribs of said first plate being disposed in an engaged crossing relationship with said inner ribs of said second plate with said inner grooves and ribs cooperating to define a first flow path therebetween, said plates having flow inlet and outlet openings communicating with said first flow path, said outer ribs having crest portions, said crest portions having projections upstanding therefrom.

10. A unit according to claim 9, wherein said projections are elongated lengthwise of said outer ribs and arranged to cross said projections of said outer ribs of said first and second adjacent units with which they engage.

11. A unit according to claim 9, wherein said outer and inner ribs and grooves extend generally along involute curves.

12. Apparatus as claimed in claim 8 wherein the unit is a first unit, and further comprising a second identical unit, the first and second units being arranged in stacked engagement with respective flow inlet and outlet openings being in registration for flow communication between respective first flow paths; the outer ribs and outer grooves of one of said first and second plates of said first unit cooperating with the outer ribs and outer grooves of one of the first and second plates of said second unit to define a second flow path therebetween; the upstanding projections on adjacent outer ribs being in engagement to space the two units apart such that the cross-sectional area of the second flow path exceeds the cross-sectional area of said first flow path.

13. Apparatus as claimed in claim 12 wherein all of the outer ribs have at least one projection formed integrally therewith.

14. Apparatus as claimed in claim 13 wherein the projections on respective ribs are staggered.

15. Apparatus as claimed in claim 13 and further comprising housing means for receiving said units and having a first flow means communicating with said first flow path and a second flow means communicating with said second flow path.

16. Apparatus as claimed in claim 9 and further comprising a flow separator located between the flow inlet and outlet openings and in sealing engagement with the plate inner surfaces.

17. Apparatus as claimed in claim 9 wherein said outer grooves and said ribs are essentially uniformly spaced and extend generally along involute curves.

* * * * *